US005531445A

United States Patent [19]

Levocz et al.

[11] Patent Number: 5,531,445

[45] Date of Patent: Jul. 2, 1996

[54] GOLF PUTTER

[76] Inventors: Reynold J. Levocz, 868 Penns Way, West Chester, Pa. 19382; Joseph W. Szewc, 2971 Belgrade St., Philadelphia, Pa. 19134

[21] Appl. No.: 490,652

[22] Filed: Jun. 16, 1995

[51] Int. Cl.[6] ..... A63B 53/08; A63B 53/16; A63B 53/04

[52] U.S. Cl. ..... 473/341; 473/306; 473/313; 473/328

[58] Field of Search ..... 273/167 A, 171, 273/80 C, 174, 167 J, 80.1, 167 H, 169

[56] References Cited

U.S. PATENT DOCUMENTS

| | | | |
|---|---|---|---|
| D. 240,245 | 6/1976 | Aragona | 273/167 A X |
| 1,840,924 | 1/1932 | Tucker | 273/171 |
| 3,319,962 | 5/1964 | Summers | 273/164 |
| 3,989,257 | 11/1976 | Barr | 273/175 |
| 4,141,556 | 2/1979 | Paulin | 273/164 |
| 4,702,477 | 10/1987 | Solomon | 273/80 C |
| 5,160,141 | 11/1992 | Crews | 273/164.1 |
| 5,267,733 | 12/1993 | Szokola | 273/167 G |
| 5,294,122 | 3/1994 | Longo | 273/162 E |
| 5,382,019 | 1/1995 | Sneed | 273/80 C |

FOREIGN PATENT DOCUMENTS

| | | | |
|---|---|---|---|
| 377463 | 7/1932 | United Kingdom | 273/167 A |

*Primary Examiner*—George J. Marlo
*Attorney, Agent, or Firm*—Breneman, Georges & Krikelis

[57] ABSTRACT

A golf putter for striking a golf ball, said golf putter comprising:

a putter head, which with reference to a front vertical planar reference surface and a bottom horizontal planar reference surface, includes a top, a sole opposite said top and tangent to said bottom reference surface, a heel, a toe, a rear surface, and a striking face having a sweet spot and a striking axis extending therethrough; the putter head further comprising a cut-out portion extending from the toe of the putter head to the heel of the putter head, at the intersection of the striking face and the sole of the putter head, the cutout portion defined by a first, substantially vertical plane, and a second, substantially horizontal plane the second plane located at a distance D1 above said reference bottom surface, said first and second planes intersecting along a line located at a distance D2 equal to D1 from outermost edge of the striking face, said outermost edge being the intersection of the striking face and said second substantially horizontal plane, and wherein D1 and D2 are between ⅛ and ⅝ inches; and an elongated shaft having a distal end and a proximate end connected to said putter head at a point behind said rear surface on said striking axis of said sweet spot.

4 Claims, 3 Drawing Sheets

13
10
15
α
42
44
46
20
37
22
40
55
38
45
36
24
53
57
50
21
30
23
D1
D2
32
14
16

11
13'
δ
δ
6
6
42
43
42
44
20
34
46
36
21
45
55

GOLF PUTTER

BACKGROUND OF THE INVENTION

1. Field of the Invention

This invention relates generally to golf clubs and more particularly to an improved golf putter.

2. Description of Related Art

Most golfers today understand that the "short game" can make or break a round of golf. As they say, "you drive for show and you putt for dough." Accordingly, due to this increased awareness, as well as improved technology in the industry, the golf putter has undergone substantial changes in order to assist the golfer in improving his or her putting stroke.

A major problem associated with putting includes hitting the ball in an unintended direction due to various factors. Some of these factors include an inadvertent turning of the wrists during the stroke, catching the club on the grass, not hitting the ball in the sweet spot, and wobbling or deflection of the club head.

Particularly vexing is the problem of catching the putter head on the grass during the putting stroke. The putting stroke begins with a generally downward movement, and often the leading bottom edge of the putter head catches the grass just before the striking face of the putter head contacts the ball. As a result, the putting may be slowed and/or the club head position may be altered. Thus, when the ball is thereafter struck, it either will not reach the hole or it will travel in an unintended direction. This problem is particularly vexing when the ball has come to rest on the green up against the fringe, where the higher grass must be cleared by the putter head before it strikes the ball.

Another problem related to putting, concerns the inability of the golfer to consistently hit the golf ball in the "sweet spot." As is well known in the art, golf clubs include a point within the club head known as the "sweet spot." The "sweet spot" is the quintessential spot on the club face on which to strike the ball. Accordingly, it has been the object of many of the recent changes to attempt to make it easier for the golfer to hit the ball in the "sweet spot" on a more consistent basis. Some of these attempts include markings on the putter top itself, adjusting the shape of the shaft, and varying the location of the attachment of the shaft to the club head.

It is a primary object of this invention to provide a golf putter which incorporates a cut-out portion on the face of the putter head to reduce the probability of grass interference during the putting stroke.

It is yet another object of this invention to provide a putter which helps eliminate club wobble or deflection during the putting stroke.

It is an additional object of this invention to provide a putter whose use results in a more unified stroke while reducing the golfer's "thinking" over the putt.

These and other objects of the present invention will become clear from the following description.

SUMMARY OF THE INVENTION

The present invention is an improved golf putter for striking a golf ball which provides for an easier and more fluid putting stroke.

The improved golf putter comprises an elongated shaft and a putter head. The shaft has a distal end and a proximate end. The putter head has a top, a sole, a heel, a toe, a rear surface, and a striking face, and is attached to the proximate end of the shaft. The putter head further includes a cut-out portion at the intersection of the striking face and the sole of the putter head, defined by a first, substantially vertical plane, and a second, substantially horizontal plane, extending from the toe of the putter head to the heel of the putter head. The first and second planes intersect along a line where the line is located at a distance D1 from the lowermost point of the sole and at a distance D2 from the outermost edge of the striking face. The distances D1 and D2 are between one-eight (⅛) and five-eighths (⅝) inches in length.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
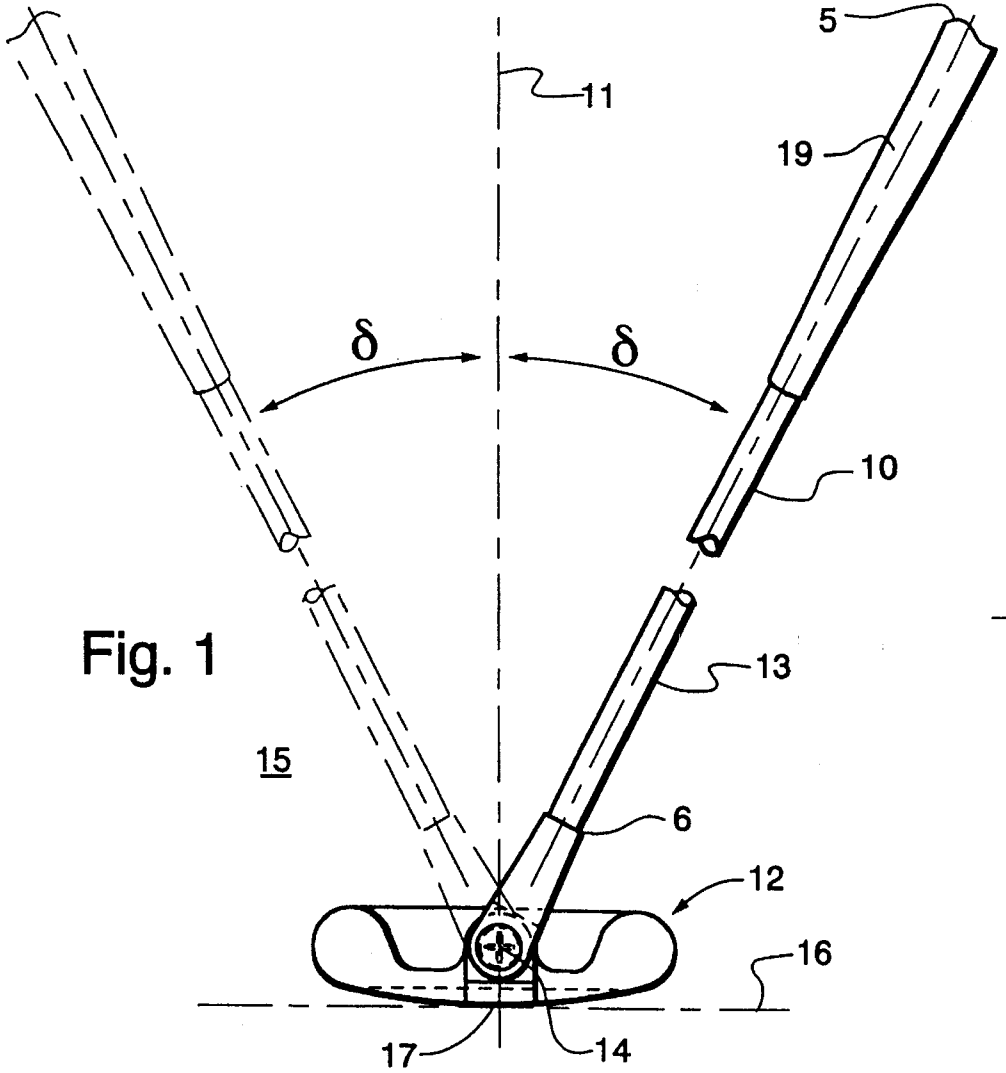
FIG. 1 is an overall view of the putter head with the shaft attached at an angle for either a left-handed or right-handed golfer.

Throughout the following detailed description, similar reference characters refer to similar elements in all figures of the drawings.

Since the putter is a free standing device which can be inclined or rotated at will, the relative orientation of the different putter plane surfaces or axes referred to in this description are to be determined as follows:

The putter head is inscribed within an imaginary rectangular parallelepided which has a front reference planar surface and a bottom reference planar surface, the bottom reference surface being horizontal and the front reference surface being vertical. The front reference surface is best shown as reference surface 15 in FIG. 6 and includes an outermost edge 23 of a striking face 22, said outermost edge being parallel to the parallelepided edge defined as the intersection of the front and bottom reference surfaces. The bottom planar reference surface is best shown in FIG. 1 as reference surface 16 and is tangent to a lowermost point 17 on a sole 21 of the putter head.

Both the outermost edge 23 and the lowermost point 17 will be described in further detail hereinbelow. The front and bottom reference surfaces define the vertical and horizontal planes used for orientation throughout the following description.

Referring now to FIG. 1 of the drawings there is shown one embodiment of a golf putter constructed in accordance with the teachings of the present invention. The golf putter includes a conventional, elongated handle shaft 10 and a putter head 12. The shaft 10 is formed of any common golf club shaft material, including, but not limited to steel, graphite, wood, or a composite. The putter head 12 may be composed of any common club head material including but not limited to brass, steel, aluminum, or any suitable metal alloy.

The shaft 10 includes a distal end 5, a proximate end 6, and a shaft axis 13 extending the shaft length. The axis 13 preferably lies in a shaft plane which is parallel to the front reference surface 15. Axis 13 forms an angle $\gamma$ measured on the shaft plane between a vertical line 11 defined as the intersection of the shaft plane and a second, vertical plane, mutually perpendicular to the front reference surface 15 and the bottom reference surface 16. In the preferred embodiment as better illustrated herein in FIGS. 2, 3, and 4, this second vertical plane contains a strike axis 14 to be described later in this specification.

Covering a portion of the distal end 5 is a conventional golf grip 19. The grip 19 can be formed of any conventional grip material including leather or rubber. The proximate end 6 is attached to the putter head 12, preferably so that the shaft axis 13 intersects the strike axis 14. The shaft 10 is connected to the putter head through an adaptor 42. The adaptor preferably attaches the shaft to the putter head 12 at a position aligned substantially behind the portion of the head known as the sweet spot 40. The adaptor 42 and the location of the sweet spot 40 will be addressed in greater detail later.

As best seen in FIGS. 2, 3, 4, and 6, the putter head 12 includes a top 20 located directly above and opposite a sole 21. In addition, the putter head 12 includes a rear surface 24 and a generally planar striking face 22 located opposite the rear surface 24. The putter head 12 finally includes a heel 25 and a corresponding toe 26 located opposite the heel 25. The rear side of the putter head may preferably include two cavities 27 and 28.

Figure 6:
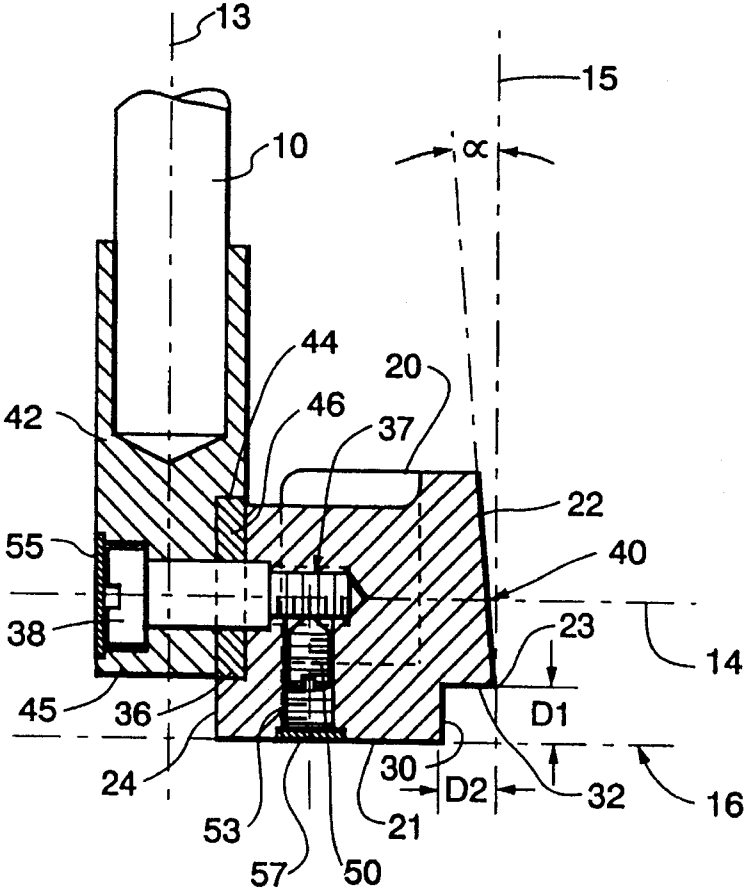
FIG. 6 is a cross-sectional view taken along line 6—6 in FIG. 5 mounted thereon.

Best illustrated with the aid of FIG. 6, in accordance with the present invention, the putter head 12 includes an angular cutout located at the intersection of the striking face 22 and the sole 21. The cut-out has a first, vertical planar side 30 and a second, horizontal planar side 32. The horizontal side 32 is located a distance D1 from the lowermost point 17 of the sole 21 of the putter head 12. The vertical side 30 is located a distance D2 from the intersection of the horizontal side 32 and the strike face 22. This intersection forms the outermost edge 23 referred to hereinabove.

Distances D1 and D2 can range from ⅛ to ⅝ inches and are preferably equidistant. In the preferred embodiment D1=D2=3/16 inches.

The striking face 22, is preferably slightly bevelled forming an angle $\alpha$ with respect to the front reference plane. The angle $\alpha$ typically varies between 1 and 3 degrees but may vary significantly from these values, depending on the golfer's wants and needs.

Figure 3:
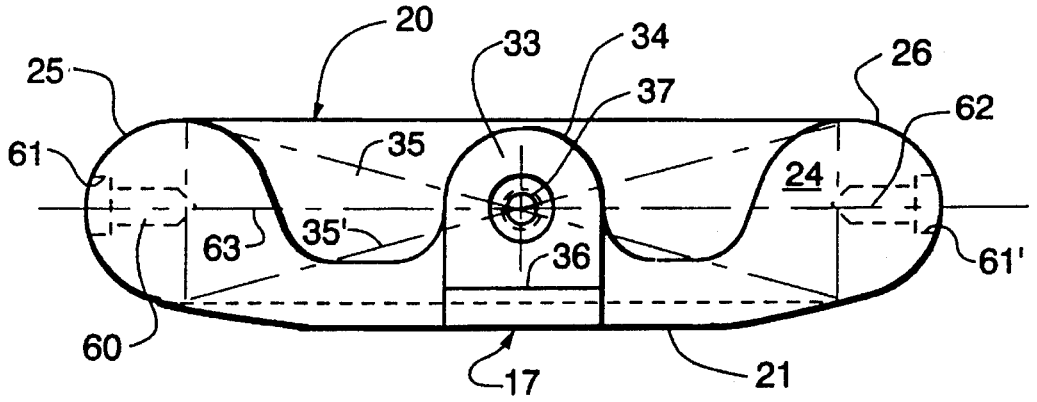
FIG. 3 is a rear elevation view of a putter head in accordance with the present invention.
Figure 4:
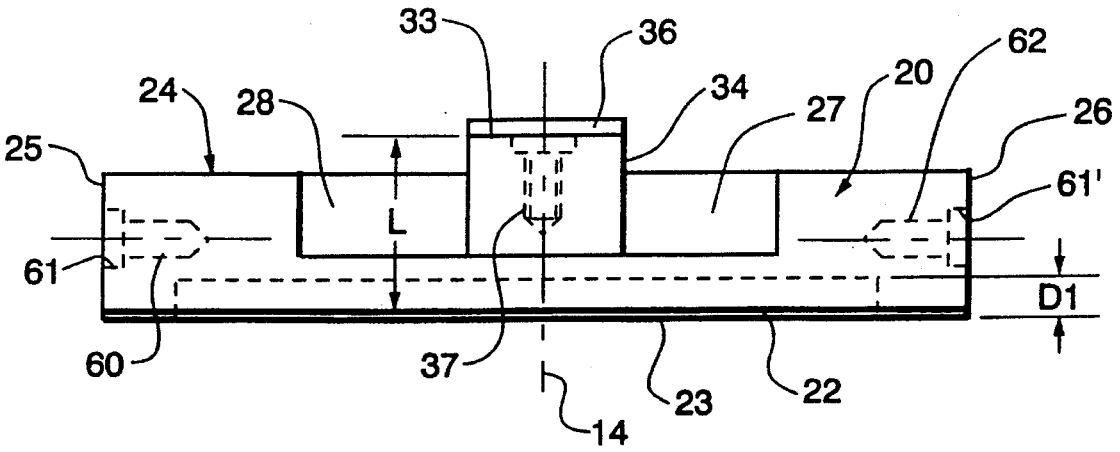
FIG. 4 is a top view of a putter head in accordance with the present invention.

Referring now to FIGS. 3 and 4, there is shown a mount 34 which extends rearwardly from the putter head. The mount includes a horizontal reference ledge 36 and a rear mount surface 33. The ledge 36 typically extends 1/16 inches from the rear mount surface 33 and will be discussed in more detail bellow. While it is preferred that the mount 34 as illustrated extends to a point beyond the putter rear surface 24, it does not have to, but can be flush with the rear surface. The rear mount surface 33 is typically located at a distance "L" from the outermost edge 23 which is between 13/16 inches and 1 and ½ inches with the preferred dimension for "L" being one inch.

In cases where the putter head does not include cavities 27 and 28, the mount can be simply a section of the rear surface, or can extend therefrom beginning from the rear surface.

In addition to the reference ledge 36 which is typically flat, and generally horizontal, the mount 34 includes a first threaded screw socket 37 for receiving a fastener such as a screw, preferably a shoulder screw. A strike axis 14 extends through the centerline of first screw socket 37. The strike axis 14 also extends through the putter head center of gravity. The point where the strike axis intersects the striking face 22 is the sweet spot 40. The sweet spot 40 is the pinnacle position of the face 22 on which to strike the golf ball. Because of its location, the sweet spot 40 provides the least "wobble" or deflection in the club head 12 at the moment the head 12 strikes the ball.

Determining the exact center of gravity of the putter head is not always simple. On the other hand it is not necessary to locate the sweet spot and strike axis with absolute accuracy, and for practical purposes the location of the sweet spot is found with sufficient accuracy, by drawing two imaginary diagonals 35 and 35' extending between opposing corners of a parallelogram defined by the outermost edge 23 and the top 20 of the head as shown in FIG. 4. The strike axis 14 is then drawn through the intersection of the diagonals perpendicular to the front reference surface.

A shoulder screw 38 is used to attach the shaft to the head. Shoulder screw 38 extends co-axially with the strike axis 14 through the shaft adaptor 42 hole 45 into the mount 34. The mount 34 preferably also includes a provision for a means to secure shoulder screw 38, which is used to assemble the shaft and head together against accidental loosening, as shown in FIG. 6. This is accomplished by providing a second screw socket 53 on the sole of the head which intersects the first screw socket 37, and a set screw 50 which may be inserted in the second socket 53 and driven against shoulder screw 38. A cap 57 is used to cover the access to the set screw and a cap 55 closes the access to the shoulder screw 38.

Figure 2:
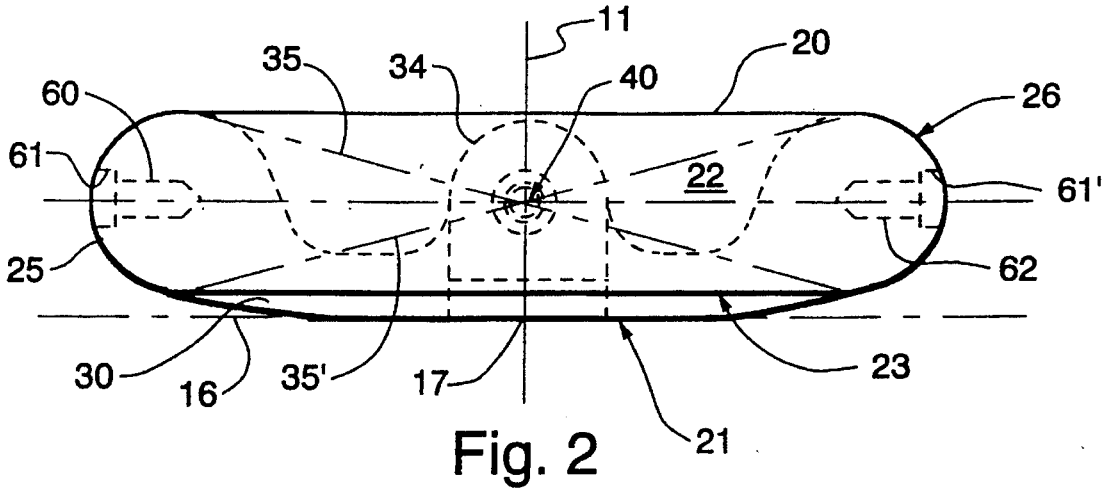
FIG. 2 is a front elevation view of a putter head in accordance with the present invention.

In the preferred embodiment illustrated in FIGS. 2, 3 and 4 there is provision for the addition of weights to the toe and heel regions of the putter head. This is done by providing two weight cavities 60 and 62 aligned along a horizontal axis 63 running through and perpendicular to the strike axis 14. Caps 61 and 61' are provided to cover the cavities once the proper weights have been inserted to weigh and balance the head for a particular user.

Preferably the weights are placed symmetrically distant from the strike axis 14, in equal amounts, in the two cavities maintaining the original center of gravity; however, the weights and/or position could be slightly unbalanced to achieve a desired "feel" to the putter. The weights are typically but not exclusively, properly sized lead inserts.

Figure 7:
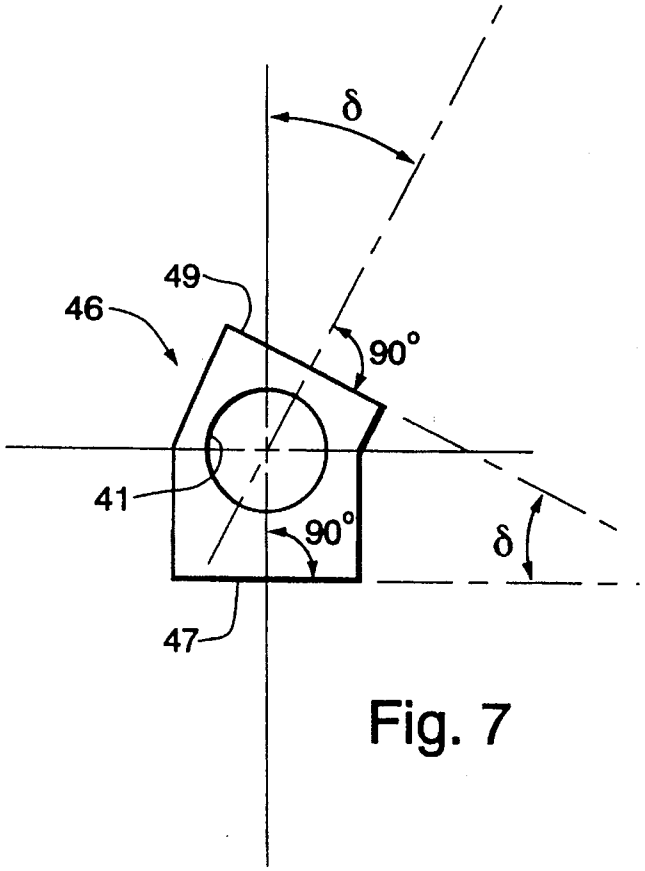
FIG. 7 is a view of a reversible key having a predetermined angle $\gamma$ in accordance with the present invention.

The handle shaft is connected to the putter head through connecting means which comprises a key 46 and a handle shaft holding adaptor 42, which are illustrated in greater detail in FIGS. 2, 6 and 7. The adaptor 42 has an upper portion which includes a cylindrical hole 43, dimensioned to accept and hold the shaft securely thereon. The hole 43 has an axis 13' which is coincident with the axis 13 of the shaft.

The lower part of the shaft adaptor 42 includes a second planar reference ledge 44 which is perpendicular to the adaptor axis 13'. The lower part also includes a circular opening 45 sized to accept shoulder screw 38 with substantially no play.

The key 46 also comprises two reference planar surfaces, lower key reference surface 47 and upper key reference surface 49. The angle between the two surfaces is an angle $\gamma$ which is typically between 15 and 20 degrees. The key also includes a circular hole 41 located so that when its center is placed on the striking axis, lower reference surface 47 is in intimate contact with horizontal reference ledge 36. Similarly the distance from the center of hole 41 to the upper key reference surface 49 equals the distance from the center of circular opening 45 on the lower portion of adaptor 42 to reference ledge 44 on the adaptor. Hole 41 is also sized to accept shoulder screw 38 with substantially no play.

Figure 5:
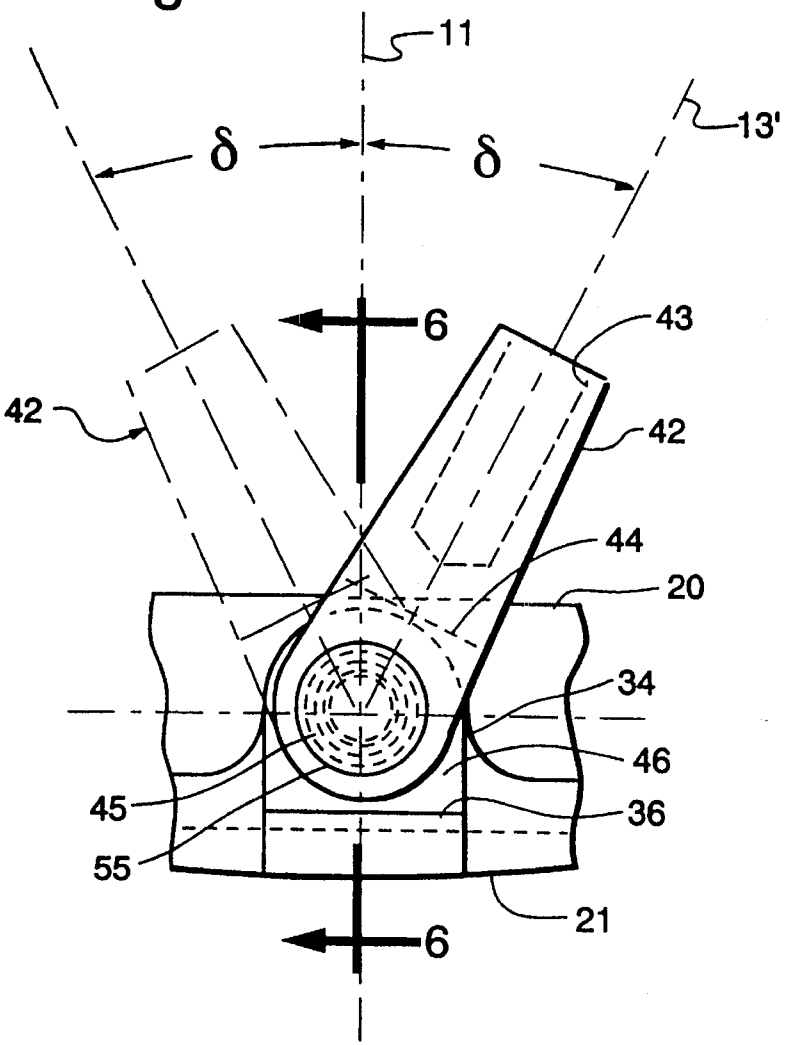
FIG. 5 is a schematic elevation view of the shaft and adaptor holding the shaft on the head.

The key front and back sides are flat and parallel. The key may thus be mounted on the mount 34 so that the upper key reference surface 49 is inclined either to the left or to the right simply by flipping the key around and has a thickness of between 3/64 and 1/8 inches. Thus the keys are reversible locating the shaft handle inclined either to the left or to the right, as shown in phantom lines in FIGS. 1 and 5. The keys are typically made of a dimensionally stable material, stainless steel, bronze, brass, or aluminum, the latter being preferred.

As is readily understood from the above description of the elements comprising the putter, and as illustrated in FIGS. 2 and 6, the handle shaft and putter head are assembled using shaft adaptor 42 and any one of a number of keys 46 having predetermined different angles γ to provide a putter having any one of a desirable predetermined angles between the putter head and the handle shaft to accommodate specific golfer preferences. Furthermore changes in the angle and or putter weight can be obtained with relative ease at minimal expense.

In assembling the putter, first a key 46 is selected to provide a desired initial angle γ between shaft and putter head, for instance a key in which the angle γ is 18°. The key is then placed between the adaptor 42 and the mount 34, flat against the rear mount surface 33, with the key reference surface 47 on the horizontal reference ledge 36 of the mount, and the key reference surface 49 facing either left or right depending whether the golfer is right or left handed. The adaptor is placed onto the key with the upper reference surface 49 of the key 46 in contact with the adaptor ledge 44 and the shoulder screw 38 is inserted through the adaptor and key holes 45 and 41 respectively into the mount screw socket 37, securing the assembly. After the shoulder screw is tightened, the set screw is set to press against the shoulder screw, and caps 55 and 57 are placed in place restricting further access to either the shoulder screw 38 or set screw 50, in effect rendering the putter legal for use in a tournament. It is preferred that the set screw be a NY-Loc set screw and that it presses against the threads of the shoulder screw.

Should the golfer for any reason desire to alter the angle of the handle shaft to the putter head, the above process is reversed and a different key having a different angle γ is used. In accordance with the present invention there is contemplated to make available for the golfer a plurality of keys differing by 1° increments.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A golf putter for striking a golf ball, said golf putter comprising:

a putter head, which with reference to a front vertical planar reference surface and a bottom horizontal planar reference surface, includes a top, a sole opposite said top and tangent to said bottom reference surface, a heel, a toe, a rear surface, and a striking face having a sweet spot and a striking axis extending therethrough;

the putter head further comprising a cut-out portion extending from the toe of the putter head to the heel of the putter head, at the intersection of the striking face and the sole of the putter head, the cutout portion defined by a first, substantially vertical plane, and a second, substantially horizontal plane, the second plane located at a distance D1 above said reference bottom surface, said first and second planes intersecting along a line located at a distance D2 equal to D1 from an outermost edge of the striking face, said outermost edge being the intersection of the striking face and said second substantially horizontal plane, and wherein D1 and D2 are between 1/8 and 5/8 inches; and an elongated shaft having a distal end and a proximate end connected to said putter head at a point behind said rear surface on said striking axis of said sweet spot.

2. The golf putter of claim 1 wherein D1 is 3/16 inches.

3. The golf putter of claim 1 wherein the heel and the toe of the putter head each has a portion removed to define a weight port, each of said weight ports being positioned along an axis parallel to said striking face.

4. The golf putter of claim 1 wherein the striking face of the putter head is beveled at an angle ranging from approximately 1° to approximately 3°.

* * * * *